US005470434A

United States Patent [19]

Terasawa et al.

[11] Patent Number: 5,470,434

[45] Date of Patent: Nov. 28, 1995

[54] DECAY-RESISTANT PAPER FOR THE MANUFACTURE OF A POT FOR RAISING AND TRANSPLANTING SEEDLINGS, AND THE PROCESS FOR PRODUCING THE SAME

[75] Inventors: Hidekazu Terasawa; Masashi Tanimura; Sumio Ito, all of Obihiro, Japan

[73] Assignee: Nihon Tensaiseito Kabushiki Kaisha, Tokyo, Japan

[21] Appl. No.: 361,153

[22] Filed: Dec. 21, 1994

Related U.S. Application Data

[63] Continuation of Ser. No. 22,171, Feb. 25, 1993, abandoned.

[30] Foreign Application Priority Data

Mar. 27, 1992 [JP] Japan ..... 4-100335

[51] Int. Cl.[6] ..... D21H 25/06

[52] U.S. Cl. ..... 162/117; 162/134; 162/158; 162/166; 162/206

[58] Field of Search ..... 162/166, 207, 162/224, 134, 117, 158, 206; 47/74

[56] References Cited

U.S. PATENT DOCUMENTS

| | | | |
|---|---|---|---|
| 2,877,498 | 3/1959 | Schneider | 162/166 |
| 3,798,120 | 3/1974 | Enloe et al. | 162/134 |
| 4,610,761 | 9/1986 | Eklund et al. | 162/166 |

FOREIGN PATENT DOCUMENTS

| | | |
|---|---|---|
| 49-35138 | 4/1974 | Japan . |
| 60-501317 | 8/1985 | Japan . |
| PCT/FI84/00040 | 11/1984 | WIPO . |

*Primary Examiner*—Peter Chin
*Attorney, Agent, or Firm*—Oliff & Berridge

[57] ABSTRACT

Decay-resistant paper suitable for the manufacture of a pot for raising and transplanting seedling is the one partly containing decayable portions, which is prepared by heating paper made of a natural fiber, or a fiber blend composed of a natural fiber and a synthetic fiber, and impregnated with a compound capable of crosslinking the paper cellulose, at a temperature causing the reaction of antidecay treatment and at a temperature causing no such reaction in different portions. Such decay-resistant paper partly containing decayable portions can be easily prepared by bringing the above-mentioned paper impregnated with a compound capable of crosslinking the paper cellulose into contact in a single step with a heating apparatus comprising a heating part of a temperature causing the reaction of antidecay treatment and a heating part of a temperature causing no such reaction. As such a heating apparatus, may be used the one in which a rotary roll heater or a press-type heating plate is coated with a jacket having openings which is made of a material such as iron, copper and aluminum.

6 Claims, 2 Drawing Sheets

DECAY-RESISTANT PAPER FOR THE MANUFACTURE OF A POT FOR RAISING AND TRANSPLANTING SEEDLINGS, AND THE PROCESS FOR PRODUCING THE SAME

This is a Continuation of application Ser. No. 08/022,171, filed Feb. 25, 1993, now abandoned.

BACKGROUND OF THE INVENTION

1. Field of the Invention

This invention relates to decay-resistant paper for the manufacture of a pot for raising and transplanting seedlings, which is characterized in that it partly contains decayable portions, and to an improved process for easily producing the same.

2. Description of the Prior Art

The method of cultivating plants by raising and transplanting of seedlings by the use of a pot of four- or six-cornered cylinder without lid and bottom (or with a bottom), which is made of a film of paper or the like, has been expensively employed.

In this plant cultivation method, and above-described pot is filled with culture soil, seeds are sowed therein, the seedlings are grown under controlled applying of water, and the pot is planted in a field. After the transplantation, the pot gradually breaks in the field as a result of decay, thereby allowing free extension of roots out of the pot walls.

However, the decay of the pot after transplantation depends strongly on the properties of the soil; when the decay is slow, said free extension of roots may be obstructed, thus delaying the plant growth of the beginning stage.

Accordingly, the paper used for the manufacture of a pot for raising and transplanting of seedlings is required to have a sufficiently high strength under dry conditions (tear strength) to be proof against mechanical handling during the pot manufacture (folding and stretching), to have a sufficiently high strength under wet conditions to be proof against artificial and mechanical handling during raising and transplanting of seedlings, and to show a high degree of breakage after transplantation regardless of the properties of soil, thus breaking rapidly to allow free extension of roots.

In recent years, various kinds of paper for the manufacture of a pot for raising and transplanting seedlings having the properties described above have been proposed. For example, Japanese Patent Laid-Open No. 35138/'74 disclosed a process for producing decay-resistant paper partly containing decayable portions, which is characterized in that, when making decay-resistant paper by treating the pulp cellulose with a reagent capable of crosslinking and hindering the hydroxyl groups in cellulose (such as formaldehyde), a water-repellent compound, such as paraffin, is previously attached to the paper surface in the pepper-and-salt or polka-dotted form, thereby partly preventing the crosslinking between cellulose and the reagent and hindering reactions between the hydroxyl groups and the reagent. Japanese Patent Laid-open No. 501317/'85, and the corresponding U.S. Pat. No. 4,610,761, disclosed a process for producing decay-resistant paper partly containing decayable portions, which is characterized in that, when making paper decay-resistant by treating the paper with an N-methylol compound, a compound containing carboxyl groups is previously attached to the paper surface in preset portions, thereby preventing antidecaying treatment in these portions.

These prior arts are characterized in that a water-repellent compound (such as paraffin) or a compound containing carboxyl groups is attached to the paper surface in preset portions prior to antidecay treatment of the paper. However, it is practically very difficult to attach any of these compounds correctly according to the desired pattern. In addition, attachment of a water-repellent compound without any flow and penetration of a compound containing carboxyl groups only in the desired portions involve the problems to be solved, because the processing rate is restricted, thereby lowering the production efficiency and raising the production cost.

SUMMARY OF THE INVENTION

This invention contrived a practical method for solving the problems of the prior arts as described above. When crosslinking the cellulose of paper made from a properly selected natural fiber, the paper is treated with an N-substituted derivative of urea over the whole surface, the paper thus treated is then heated in a single step at a temperature causing the reaction of antidecay treatment and at a temperature causing no such reaction in different portions, thereby producing decay-resistant paper partly containing decayable portions. Preparation of decay-resistant paper partly containing decayable portions by such a process is a technique which is quite different from the prior arts described above and cannot be suggested by the same. The process of this invention can produce very easily decay-resistant paper of any desired shape which partly contains decayble portions and is free from the danger of getting out of shape, thus solving the problems involved by the conventional techniques.

DETAILED DESCRIPTION OF THE INVENTION

Figure 1:
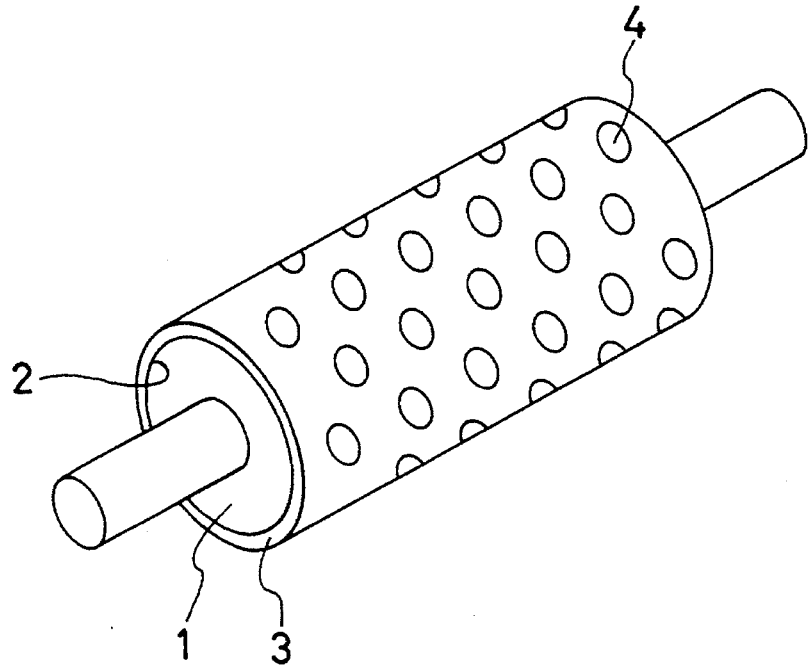
FIG. 1 is a squint-viewed diagram typically illustrating an example of the heating apparatus.
Figure 2:
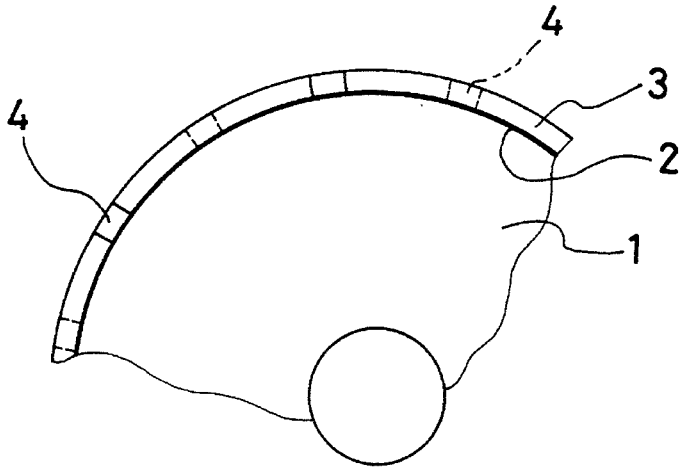
FIG. 2 shows a part of the transverse, sectional view of the heating apparatus shown in FIG. 1.

The natural fiber for producing the decay-resistant paper of this invention described above is the material commonly employed for the manufactue of paper, and as the pulp material, may be mentioned unbleached, semi-bleached and bleached kraft pulp, sulfite pulp, semi-chemical pulp, soda pulp, mechanical pulp from needle-leaf trees and from broad-leaf trees, as well as collected used paper and rags. These materials may be used either alone or in combination.

A material properly selected from those described above (for example, unbleached pulp) is used to make a kraft wrapper with a definite width, and this kraft wrapper is sufficiently impregnated with at least one kind of N-substituted derivative of urea having at least two reactive radicals (at least one kind of radicals among hydroxyl and methylol groups) (hereinafter abbreviated as "N-substituted derivative of urea") in the presence of a catalyst, such as magnesium chloride ($MgCl_2.6H_2O$), followed by dehumidification and heating at a reaction temeprature; this reaction temperature varies depending on the material of the paper and the degree of antidecay treatment required, and is therefore set based on these factors.

The N-substituted derivatives of urea mentioned above are thermosetting resins generally called cellulose-reactive resins, which are known to react with the hydroxyl groups in cellulose by heating in the presence of a catalyst to form crosslinks between hydroxyl groups or methylol groups, thus hindering the hydroxyl groups and removing the hydrophilic nature, and the paper is thus provided with the resistance against the action of soil microorganisms (decay-resistance). As examples of the N-substituted derivatives of urea, maybe mentioned dimethylol urea (DMU), dimethylol ethylene urea (DMEU), dihydroxy ethylene urea (DHEU) dimethylol dihydroxy ethylene urea (DMDHEU) and tetramethylol acetylenediurea (TMADU).

The characteristics required for decay-resistant paper suitable for the manufacture of a pot for raising and transplanting of seedlings are as follows; (1) a sufficiently high strength under dry conditions to be proof against mechanical handling (folding and stretching) during the pot manufacture (hereinafter referred to as "tear strength"), (2) a sufficiently high strength under wet conditions to be proof against mechanical and artificial handling during transplantation (hereinafter referred to as "wet tensile strength of burial test"), and (3) a high degree of brittleness to allow free extension of roots through the pot wall after transplantation. It is not easy to obtain paper having all of the characteristics (1) through (3), because the characteristics of (2) and (3) are contrary to each other.

The prior arts described above were intended to ensure the characteristics (3), but the problem described above is left unsolved.

This invention was intended to obtain paper having all of the characteristics (1) through (3) described above. When unbleached kraft pulp was selected among the abovementioned group of natural fibers, it was found, as shown in Table 1, that the kraft wrapper made from the same by the commonly employed method shows a strength under wet conditions of 10 kg/60 mm or higher when buried in soil (water content: 35±5%; temperature: 30°±3° C.) for 14 days (wet tensile stregth of burial test) and shows a strength under dry conditions of about 20 g (tear strength) if the kraft wrapper impregnated with an antidecaying agent is heated for three minutes at a temperature of 150° to 160° C., and that, if the heating temperature is 130° C. or lower, embrittlement due to decay of the paper proceeds in a high degree, indicating that antidecay treatment by crosslinking reaction cannot be performed.

If the heating temperature exceeds 160° C., on the other hand, a satisfactory level of strength under buried conditions can be obtained, but the paper stiffens in an excessively high degree, thus lowering the tear strength (an excessive degree of antidecay treatment).

TABLE 1

| Temperature (°C.) | Wet tensile strength of burial-test (kg/60 mm) | Tear strength (g) |
|---|---|---|
| 125 | unmeasurable | 52.3 |
| 130 | unmeasurable | 49.3 |
| 135 | 1.29 | 37.7 |
| 140 | 1.41 | 32.4 |
| 145 | 9.80 | 28.5 |
| 150 | 15.18 | 25.6 |
| 155 | 16.69 | 21.9 |

TABLE 1-continued

| Temperature (°C.) | Wet tensile strength of burial-test (kg/60 mm) | Tear strength (g) |
|---|---|---|
| 160 | 16.32 | 20.0 |
| 165 | 16.79 | 18.9 |

1) Temperature of roll heater's surface

2) Measured by a Schopper tensile tester according to JIS-P8113

3) Measured by an Elmendorf tear tester according to JIS-P8116

Other conditions:

(1) The basis weight of kraft wrapper is 55 g/m$^2$.

(2) The antidecaying agent used is an aqueous solution containing 10 weight % of DMDHEU and 2.5 weight % of $MgCl_2.6H_2O$, and the amount of DMDHEU attached is 5 weight % on a dry basis.

(3) Heating time is three minutes.

The proper reaction temperature mentioned above was set in order to satisfy the above-described conditions, and hence varies with the kind of paper to be treated and the required characteristics. Accordingly, the satisfactory treating conditions (heating temperature and time) should be set in each case by the way as shown in Table 1.

The data shown in Table 1 indicates that, in order to obtain decay-resistant paper for the manufacture of a pot for raising and transplanting seedlings, a kraft wrapper should be treated, for example, at a temperature of 150° to 160° C. for three minutes, and that heating at a temperature lower than 130° C. for three minutes causes no reaction of antidecay treatment, thus leaving decayable paper.

This indicates that a heating temperature of 150° to 160° C. ensures the crosslinking of cellulose by the antidecaying agent to perform satisfactory antidecay treatment in this example.

On the other hand, a heating temperature lower than 130° C. does not cause the crosslinking reaction, thus ensuring to leave decayable paper.

This invention, which is based on these findings, was intended to rapidly produce paper containing both decayable and undecayable portions by heating a raw paper at a temperature causing the reaction of antidecay and at a temperature causing no such reaction in a single step, and hence such an idea is quite novel and cannot be suggested from the techniques described in the prior arts described above.

Described below is a process of this invention in which a paper is impregnated with an N-substituted derivative of urea over the whole surface and then heated in a single step, thereby producing a paper containing both decayable and undecayable portions. A kraft wrapper as described above is sufficiently impregnated with an aqueous solution containing 10 weight % of dimethylol dihydroxy ethylene urea (DMDHEU) and 2.5 weight % of magnesium chloride ($MgCl_2.6H_2O$), followed by dehumidification and drying, and the dried paper thus obtained is heated for three minutes at various temperatures by the use of a jacketed, roller heating apparatus as shown in FIG. 1, in which the rotary surface 2 is covered with a jacket 315 mm thick having openings 48 mm in diameter arranged in plural columns (17 mm apart from each other) in the rotary direction of the roll heater 1 (at intervals of 20 mm in each of the columns, and apart by ½ pitch between adjacent columns).

The jacket 3 may be made of any material insofar as it is sufficiently thermostable and has a proper degree of heat transfer efficiency, stiffness, resistance to compression and perforation processing characteristics, such as iron, copper and aluminum. A jacket made of iron is used in the case described above, and the thickness of jacket should be set by taking into consideration the even balance between the temperature causing the reaction of antidecay treatment and the temperature causing no such reaction.

Figure 4:
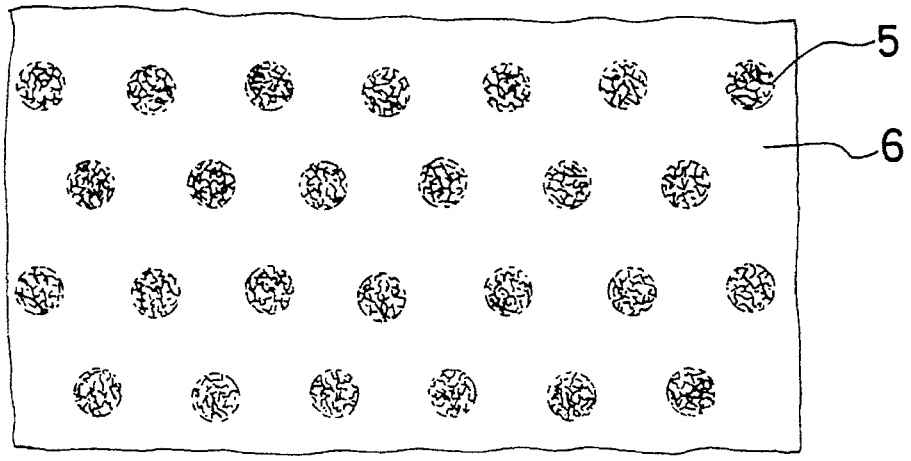
FIG. 4 is a horizontal view illustrating the state of a test piece of the decay-resistant paper of this invention embedded in soil.

Table 2 shows the result of heating at various temperature by using the above-described heating apparatus. FIG. 4 shows the state of a test piece buried in soil for 14 days, indicating that only portions 5 broght into contanct with the openings 48 mm in diameter of the jacket 3 were clearly decayed in the same shape as that of the openings 4 and no decay is observed in the other portions. This demonstrates that the crosslinking (antidecaying) reaction does not take place only in the portions brought into cotact with the openings 4 in the jacket 3, and that decay-resistant paper partly containing decayable portions can be produced by heating a kraft wrapper impregnated with an antidecaying agent (such as an aqueous solution containing DMDHEU and $MgCl_2.6H_2O$ as described above) through a single-step operation by the use of a heating apparatus with the above-described structure.

TABLE 2

| Temperature (°C.) | | Wet tensile | |
|---|---|---|---|
| Jacket Surface | Upper Surface of opening | strength of burial test (kg/60 mm) | Tear strength (g) |
| 125 | 77 | Unmeasurable | 55.5 |
| 130 | 87 | Unmeasurable | 51.9 |
| 135 | 96 | 1.19 | 40.0 |
| 140 | 99 | 1.30 | 34.5 |
| 145 | 101 | 9.02 | 30.4 |
| 150 | 103 | 14.00 | 27.0 |
| 155 | 105 | 15.40 | 23.7 |
| 160 | 108 | 15.50 | 21.5 |
| 165 | 110 | 15.68 | 20.3 |

The antidecaying agent used and its attached amount, heating time, and the methods measuring the wet strength of buried test and the tear strength are the same as in Table 1.

The temperature of the opening upper surface (with which paper is brought into contact) is lower by about 35% than the temperature of the jacket surface; when the temperature of the jacket surface is at a level causing the reaction of antidecay treatment (150° to 160° C.), the temperature of the opening upper surface is at a level of 103° to 108° C., which causes no reaction of antidecay treatment of the paper in contact with the same.

Figure 3:
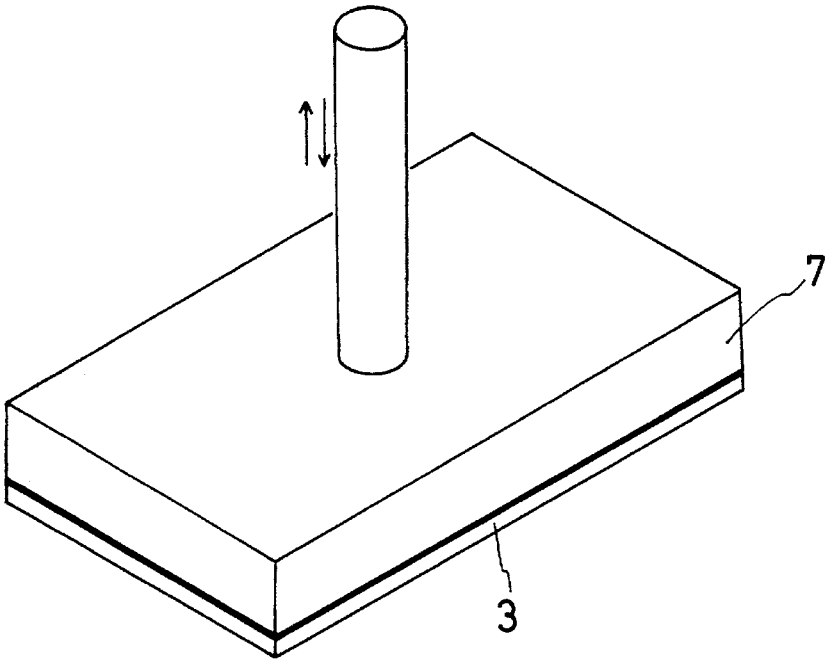
FIG. 3 is a squint-viewed diagram typically illustrating another example of the heating apparatus.

The conditions causing the reaction of antidecay treatment and those causing no such reaction vary with the kind of paper to be treated and the required characteristics also in this case, and hence the proper treating conditions should be set in each case by the way as shown in Table 2. The kind of heating apparatus to be used is not restricted to the one with a jacket 3 coated on a roller heater 1, and a heating apparatus with a jacket 3 covering the under surface of a press-type heating plate 7, as shown in FIG. 3, may also be employed; what is essential is that a paper impregnated with an N-substituted derivative of urea over the whole surface can be heated at a temperature causing the reaction of antidecay treatment and at a temperature causing no such reaction in a single step.

In addition, a paper made from a fiber blend composed of a natural fiber and a synthetic fiber can also be made decay-resistant by the process of this invention.

The process of making a fiber made from such a fiber blend decay-resistant by an N-substituted derivative of urea was disclosed in Japanese Patent Publication No. 23640/'91, but this prior technique is to make the whole surface of paper decay-resistant and is quite different from the process of this invention to produce decay-resistant paper partly containing decayble portions.

If a paper made from a fiber blend composed of a natural fiber and a synthetic fiber is made decay-resistant with an N-substituted derivative of urea by the resistant with an N-substituted derivative of urea by the process of this invention, the strength of the decay-resistant paper under dry conditions is satisfactorily high, thus compensating the decline of tear strength generally caused by antidecay treatment. As preferable examples of the synthetic fiber to be mixed with natural fiber, may be mentioned those which are high in thermal stability and are stable at the temperature causing the reaction of antidecay treatment, such as polyvinyl alcohol, polyester and polyamide fibers, but any other kinds of fibers may also be employed insofar as the thermal stability is sufficiently high.

Table 3 shows the result of antidecay treatment of two kinds of wrapper made by using, as a synthetic fiber, vinylon (a polyvinyl alcohol fiber) and polyethylene terephthalate (PET fiber; a polyester fiber) separately by the use of the roller heating apparatus 1 with a jacket 3 having openings 4 (with the jacket surface temperature being set at 160° C.). This indicates that the proper amount of vinylon and PET fiber to be mixed with natural fiber is 40% based on the weight of the natural fiber in terms of tear strength and wet strength of burial test.

TABLE 3

| Mixing rate of synthetic fiber (W/W %) | Attached amount of DMDHEU[1)] | Wet tensile strength of burial test (kg/60 mm) | | Tear strength (g) | |
|---|---|---|---|---|---|
| | | Vinylon | PET fiber | Vinylon | PET fiber |
| 0 | 5.0 | 15.45 | 15.45 | 20.6 | 20.6 |
| 2 | 5.0 | 15.14 | 15.04 | 25.5 | 26.0 |
| 3 | 4.9 | 14.84 | 14.53 | 27.6 | 28.3 |
| 5 | 4.8 | 14.68 | 14.24 | 31.7 | 33.4 |
| 10 | 4.8 | 13.91 | 13.39 | 42.3 | 46.1 |
| 15 | 4.6 | 13.17 | 12.36 | 53.6 | 58.9 |
| 20 | 4.5 | 12.43 | 11.97 | 64.2 | 71.6 |

TABLE 3-continued

| Mixing rate of synthetic fiber (W/W %) | Attached amount of DMDHEU[1)] | Wet tensile strength of burial test (kg/60 mm) | | Tear strength (g) | |
|---|---|---|---|---|---|
| | | Vinylon | PET fiber | Vinylon | PET fiber |
| 30 | 4.5 | 11.16 | 11.01 | 86.8 | 97.1 |
| 40 | 4.4 | 10.50 | 10.04 | 108.5 | 122.6 |
| 50 | 4.2 | 8.68 | 8.50 | 130.6 | 148.1 |

[1)]Calculated from the difference in weight before and after attachment of the antidecaying agent on a dry basis.
The kind of antidecaying agent, the heating time, wet tensile strength of burial test and the tear strength are the same as those in Table 1.
(Specifications of synthetic fibers)
Vinylon: 1 denier, 5 mm long,softening point: 220–230° C.
PET fiber: 1 denier, 5 mm long, softening point: 235–240° C.

The process of this invention, which produces decay-resistant paper partly containing decayable portions simply by heating a paper impregnated with an antidecaying agent over the whole surface at two different temperatures in a single step, is essentially different from the prior techniques, in which the paper is treated by a compound preventing the antidecay treatment prior to the step of antidecay treatment. Accordingly, the process of this invention which need not use such a compound preventing the antidecay treatment is simple in operations and is high in productivity, and is therefore highly excellent and valuable compared with the prior techniques.

As is detailed above, this invention provides a rational and practical technique of producing decay-resistant paper partly containing decayable portions, and various changes and modifications may be carried out without departing from the spirit and scope of this invention.

In addition, treating conditions may not be restricted to those described above; for example, the shape of decayable portions may also be rectangular, triangular or corrugated, and the impregnation of paper with antidecaying agent may also be performed by immersion in a solution of the same, showering by the use of a spray nozzle, or addition in the process of paper making.

Unlike the prior techniques, the process of this invention does not require the use of a compound capable of preventing the antidecay treatment prior to said treatment, and this removes the cost of said compound used in those treatment and enhances the productivity. Furthermore, early root extension through the pot wall after transplantation is accelerated, thus greatly contributing to the manufacture of pots and to the culture of plants with the pot.

The following preferable Examples will further illustrate the invention but are not intended to limit its scope.

EXAMPLE 1

A kraft wrapper 60 g/m$^2$ in basis weight and 800 mm in width, made from unbleached kraft pulp by the method commonly employed, was pulled out at a speed of 20 m/min. and passed through a bath filled with an aqueous solution containing 10 weight % of dimethylol dihydroxy ethylene urea (as an antidecaying agent) and 2.5 weight % of magnesium chloride ($MgCl_2.6H_2O$) with a retention time of 0.5 minute, and the kraft wrapper thus impregnated with the antidecaying agent was dehumidified by the use of a rubber roller and then dried to a moisture content of 8% through passage in an oven drier set at 90° C.

A part of this dried paper was taken as a test piece, and the attached amount of dimethylol dihydroxy ethylene urea was calculated from the difference in weight before and after impregnation, indicating that it is 5 weight % on a dry basis.

The dried, kraft wrapper impregnated with the antidecaying agent was heated by the use of a jacketed, roller heating apparatus as shown in FIG. 1, in which the rotary surface (810 mm in length and 1500 mm in diameter) is covered with an iron jacket 15 mm thick having openings 8 mm in diameter arranged in 48 columns (17 mm apart from each other) in the rotary direction (at intervals of 20 mm in each of the columns, and apart by ½ pitch between adjacent columns), with its number of revolution being set at 0.27 per minute, with the wrapping length of the wrapper around the same being adjusted to 3.8 m and with the jacket-surface temperature being set at 160° C., thus producing a decay resistant paper of this invention made of a natural fiber and partly containing decayable portions, which was wound up around a feeler. The temperature of the portions above the openings was 105° C.

As Comparative Example 1, the dried kraft wrapper impregnated with the antidecaying agent obtained above was heated under the same conditions as above by using a jacketed, roller heating apparatus similar to the one employed above except that the jacket has no opening, thus producing a decay-resistant paper containing no decayable portion, which was also wound up around a reeler.

Test pieces were taken from the decay-resistant papers of this invention (Example 1) and Comparative Example 1, and the tear strength and the strength under embedded conditions (for two weeks in soil) of these test pieces were measured. By using each of these two kinds of decay-resistant paper, were prepared 100 pieces of pots of square cylindrical shape 40 mm in side length and 40 mm in height, these pots were arranged with 10 pieces in both longitudinal and horizontal directions and combined with each other by using a water-soluble paste to form a set of pots, culture soil was filled therein, seeds of lettuce were sowed therein (one in each pot), and raising seedling was carried out for 21 days by conventional procedure. It was found that, in the pots made from the decay-resistant paper of this invention (Example 1), the wall became brittle as a result of decay in the portions in contact with the jacket openings, and the other portions were not strikingly decayed, thus maintaining a sufficiently high strength to withstand the treating operations. On the other hand, the decay-resistant paper in the Comparative Example 1 was not decayed, thus maintaining a sufficiently high strength to withstand the treating operations.

All the seedlings with the pots were then transplanted to a field, and the state of root extension through the pot walls was observed after 30 days.

The results of paper-strength measurement and the state of root extension are shown in Table 4. The paper strength under dry and wet conditions was sufficently high in both kinds of decay-resistant paper, but the state of root extension through the pot walls made of the decay-resistant paper of this invention (Example 1) was about 20% better compared with the case of Comparative Example 1.

TABLE 4

| Kind of decay-resistant paper | Tear strength (g) | Wet tensile strength burial test (kg/60 mm) | Average no. of roots through the pot walls (number/pot) |
|---|---|---|---|
| Present invention Example 1 | 23.5 | 16.9 | 37 |
| Comparative Example 1 | 21.8 | 17.8 | 29 |

EXAMPLE 2

A synthetic-fiber-blended, kraft wrapper 50 g/m$^2$ in basis weight and 800 mm in width made from a fiber blend composed of 100 parts by weight of bleached kraft pulp and 5 parts by weight % of PET fiber (1 denier, 5 mm long) by the method commonly employed (hereinafter referred to as "synthetic-fiber-blended wrapper-a") was pulled out at a speed of 20 m/min. and passed through a bath filled with an aqueous solution containing 8 weight % of dimethylol ethylene urea (as an antidecaying agent) and 2.5 weight % of magnesium chloride ($MgCl_2.6H_2O$) with a rentention time of 0.5 minute, and the kraft wrapper thus impregnated with the antidecaying agent was dehumidified by the use of a rubber roller and then dried to a moisture content of 8% through passage in an oven drier set at 90° C. A part of this dried paper was taken as a test piece, and the attached amount of dimethylol ethylene urea was calculated from the difference in weight before and after impregnation, indicating that it is 4 weight % on a dry basis.

This dried, synthetic-fiber-blended, kraft wrapper impregnated with the antidecaying agent was heated by the use of the same heating apparatus as used in Example 1 under the same conditions, thus producing a decay-resistant paper of this invention (Example 2) made of a fiber blend and partly containing decayable portions, which was wound up around a reeler. The temperature of the portions above the jacket openings was 110° C.

As Comparative Example 2, the dried synthetic-fiber-blended, kraft wrapper impregnated with the antidecaying agent obtained above was heated by using the same heating apparatus as used in Comparative Example 1 under the same conditions as in Example 2, thus producing a decay-resistant paper of Comparative Example 2 containing no decayable portion, which was also wound up around a reeler.

Test pieces were taken from the decay resistant papers of this inventions (Example 2) and Comparative Example 2, and the tear strength and the strength under embedded conditions (for two weeks in soil) of these test pieces were measured. By using each of these two kinds of decay-resistant paper, were prepared 100 pieces of pots of hexagonal cylindrical shape 25 mm in major axis and 40 mm in height, these pots were arranged with 10 pieces in both longitudinal and horizontal directions and combined with each other by using a water-soluble paste to form a set of pots, culture soil was filled therein, seeds of onion were sowed therein (two in each pot), and raising of seedling was carried out for 65 days by conventional procedure. It was found that, in the pots made from the decay-resistant paper of this invention (Example 2), the wall became brittle as a result of decay in the portions in contact with the jacket openings, and the other portions were not strikingly decayed, thus maintaining a sufficiently high strength to withstand the treating operations. On the other hand, the decay-resistant paper in the Comparative Example 2 was not decayed, thus maintaining a sufficiently high strength to withstand the treating operations.

All the seedlings with the pots were then transplanted to a field, and the state of root extension through the pot walls was observed after 30 days. The results of paper-strength measurement and the state of root extension are shown in Table 5. The paper strength under dry and wet conditions was sufficiently high in both kinds of decay-resistant paper, but the state of root extension through the pot walls made of the decay-resistant paper of this invention (Example 2) was about 24% better compared with the case of Comparative Example 2.

TABLE 5

| Kind of decay-resistant paper | Tear strength (g) | Wet tensile strength burial test (kg/60 mm) | Average no. of roots through the pot walls (number/pot) |
|---|---|---|---|
| Present invention Example 2 | 30.3 | 13.0 | 31 |
| Comparative Example 2 | 28.0 | 14.3 | 25 |

EXAMPLE 3

A synthetic-fiber-blended wrapper 55 g/m$^2$ in basis weight and 1200 mm in width made from a fiber blend composed of 40 parts by weight of unbleached kraft pulp, 40 parts by weight of mechanical pulp and 20 parts by weight of PET fiber (2 denier, 5 mm long) by the method commonly employed (hereinafter referred to as "synthetic-fiber-blended wrapper-b") was pulled out at a speed of 20 m/min. and passed through a bath filled with an aqueous solution containing 10 weight % of dihydroxy ethylene urea (as an antidecay-ing agent) and 3 weight % of magnesium chloride ($MgCl_2.6H_2O$) with a retention time of 0.5 minute, and the wrapper thus impregnated with the antidecaying agent was dehumidified by the use of a rubber roller and then dried to a moisture content of 8% through passage in an oven drier set at 90° C. A part of this dried paper was taken as a test piece, and the attached amount of dihydroxy ethylene urea was calculated from the difference in weight before and after impregnation, indicating that it is 5 weight % on a dry basis.

This dried, synthetic-fiber-blended wrapper-b impregnated with the antidecaying agent was heated by the use of a press-type heating apparatus as shown in FIG. 3, in which the under surface of heatig plate (1000 mm in length, 1200 mm in width and 100 mm in height) is coated with the same iron jacket with openings as used in the heating apparatus of Example 1, with the jacket-surface temperature and heating time being set at 160° C. and three minutes, respectively, thus producing a decay-resistant paper of this invention (Example 3) partly containing decayable portions, which was wound up around a reeler. The surface temperature of the jacket openings was 105° C.

As Comparative Example 3, the dried, synthetic-fiber-blended wrapper-b impregnated with the antidecaying agent obtained above was heated, by using a press-type heating apparatus with a construction similar to that of the above-mentioned apparatus except that the jacket has no opening, under the same conditions as in Example 3, thus producing a decay-resistant paper of Comparative Example 3 containing no decayable portion, which was also wound up around a feeler.

Test pieces were taken from the decay-resistant paper of this invention (Example 3) and that of Comparative Example 3, and the tear strength and the wet tensile strength of burial test (for two weeks in soil) of these test pieces were measured. By using each of these two kinds of decay-resistant paper, were prepared 220 pieces of pots of square cylindrical shape 27 mm in side length and 38 mm in height, these pots were arranged with 22 pieces and 10 pieces in the longitudinal and horizontal directions, respectively, and combined with each other by using a water-soluble paste to form a set of pots, culture soil was filled therein, seeds of cabbage were sowed therein (one in each pot), and raising of seedling was carried out for 25 days by conventional procedure. It was found that, in the pots made from the decay-resistant paper of this invention (Example 3), the wall became brittle as a result of decay in the portions in contact with the jacket openings, and the other portions were not strikingly decayed, thus maintaining a sufficiently high strength to withstand the treating operations. On the other hand, the decay-resistant paper in the Comparative Example 3 was not decayed, thus maintaining a sufficiently high strength to withstand the treating operations.

The cabbage seedlings with the pots were then transplanted to a field (100 seedlings for each kind), and the state of root extension through the pot walls was observed after 30 days.

The result of paper-strength measurement and the state of root extension are shown in Table 6. The paper strength under dry and wet conditions was sufficiently high in both kinds of decay-resistant paper, but the number of roots extended through the pot walls made of the decay-resistant paper of this invention (Example 3) was about 3.4 times as much as that in the case of Comparative Example 3.

TABLE 6

| Kind of decay-resistant paper | Tear strength (g) | Wet tensile strength burial test (kg/60 mm) | Average no. of roots through the pot walls (number/pot) |
|---|---|---|---|
| Present invention Example 3 | 65.3 | 11.4 | 27 |
| Comparative Example 3 | 55.6 | 11.8 | 8 |

What is claimed is:

1. A process for producing decay-resistant paper for the manufacture of a pot for raising and transplanting seedlings characterized by the formation of decayable portions in part of the decay-resistant area, which comprises the steps of:

impregnating the whole surface of paper with an aqueous solution containing an N-substituted derivative of urea having at least two reactive radicals (at least one kind of radicals among hydroxyl and methylol groups);

drying the impregnated paper; and, thereafter simultaneously heating the paper at different temperatures with a heater having a discontinuous surface layer whereby a lower temperature at discontinuous portions of the surface layer of the heater causes no reaction with said urea derivative and a higher temperature at continuous portions of the surface layer of the heater causes a reaction with said urea derivative.

2. The process for producing decay-resistant paper for the manufacture of a pot for raising and transplanting seedlings according to claim 1, wherein said paper is made from a natural fiber.

3. The process for producing decay-resistant paper for the manufacture of a pot for raising and transplanting seedlings according to claim 1, wherein said paper is made from a fiber blend comprising a natural fiber and a synthetic fiber.

4. A process for producing decay-resistant paper, comprising the steps of:

impregnating a paper with an N-substituted derivative of urea;

drying the impregnated paper; and simultaneously heating different portions of the surface of said impregnated paper at different temperatures with a heater having a discontinuous surface layer, whereby a first said temperature at continuous portions of the surface layer of the heater causes a reaction with the N-substituted derivative of urea to produce the undecayable portions, and a second said temperature at discontinuous portions of the surface layer of the heater causes no such reaction, thus producing the decayable portions.

5. A process according to claim 4 wherein said N-substituted derivative of urea comprises at least two reactive radicals and wherein at least one of said radicals is selected from the group consisting of hydroxyl and methylol radicals.

6. A process according to claim 4 wherein the heating at a said second temperature is the only means by which a reaction between the cellulosic material and the urea derivative is prevented.

* * * * *